US008029028B2

(12) United States Patent
Akizuki et al.

(10) Patent No.: US 8,029,028 B2
(45) Date of Patent: Oct. 4, 2011

(54) DOOR LOCK DEVICE

(75) Inventors: Ryujiro Akizuki, Kariya (JP); Takashi Nishio, Kariya (JP); Yusuke Yamada, Chiryu (JP); Sho Sannohe, Chiryu (JP)

(73) Assignee: Aisin Seiki Kabushiki Kaisha, Kariya-Shi, Aichi-Ken (JP)

( * ) Notice: Subject to any disclaimer, the term of this patent is extended or adjusted under 35 U.S.C. 154(b) by 0 days.

(21) Appl. No.: 13/063,126

(22) PCT Filed: Sep. 9, 2009

(86) PCT No.: PCT/JP2009/065742

§ 371 (c)(1),
(2), (4) Date: Mar. 9, 2011

(87) PCT Pub. No.: WO2010/035638

PCT Pub. Date: Apr. 1, 2010

(65) Prior Publication Data

US 2011/0162419 A1 Jul. 7, 2011

(30) Foreign Application Priority Data

Sep. 29, 2008 (JP) ..... 2008-250936

(51) Int. Cl.
*E05C 3/06* (2006.01)

(52) U.S. Cl. ..... 292/201; 292/216; 292/DIG. 23

(58) Field of Classification Search ..... 292/201, 292/216, DIG. 23
See application file for complete search history.

(56) References Cited

U.S. PATENT DOCUMENTS 6,733,052 B2 * 5/2004 Perkins et al. ..... 292/201
6,793,255 B2 9/2004 Kobayashi et al.
2009/0243309 A1 * 10/2009 Takahashi et al. ..... 292/201
2010/0013246 A1 * 1/2010 Tomaszewski et al. ..... 292/216
2010/0072761 A1 * 3/2010 Tomaszewski et al. ..... 292/201
2010/0327609 A1 12/2010 Akizuki et al.

FOREIGN PATENT DOCUMENTS

JP 7-71151 A 3/1995
JP 2005-126923 A 5/2005
JP 4132723 B2 8/2008
JP 2009-235805 A 10/2009

OTHER PUBLICATIONS

International Search Report (PCT/ISA/210) issued on Dec. 22, 2009, by Japanese Patent Office as the International Searching Authority for International Application No. PCT/JP2009/065742.
Written Opinion (PCT/ISA/237) issued on Dec. 22, 2009, by Japanese Patent Office as the International Searching Authority for International Application No. PCT/JP2009/065742.

* cited by examiner

*Primary Examiner* — Kristina Fulton
(74) *Attorney, Agent, or Firm* — Buchanan Ingersoll & Rooney PC

(57) ABSTRACT

A door lock device includes an electrical drive source, which pivots a drive member from a predetermined neutral position, and a return urging member, which returns the drive member to the predetermined neutral position. The drive member pushes a locking lever with a first engagement portion and moves the locking lever to a lock position when the drive member moves from the predetermined neutral portion in a first direction in a state in which the locking lever is arranged at an unlock position. The drive member allows the double lock lever to move to the second position and disengages the first engagement portion from the locking lever when subsequently returned to the predetermined neutral position. The drive member pushes the double lock lever with a second engagement portion when moved again from the predetermined neutral position in the first direction.

20 Claims, 6 Drawing Sheets

DOOR LOCK DEVICE

The present invention relates to a door lock device.

In the prior art, there is a door lock device that is capable of switching a vehicle door between the three states of an unlock state, a lock state, and a double lock state (super lock state) with a single motor and without executing electrical control. In the double lock state, the shifting of the vehicle door from the lock state to the unlock state by an operation performed in the passenger compartment is prohibited. Patent document 1 describes an example of such a door lock device. In this door lock device, a motor powers and rotates a rotary member in a forward direction from a neutral position. This moves a sill knob drive lever to a lock side and switches a lock mechanism to a lock state but does not move an operation lever, which counters the elastic force of a holding spring. When the lock mechanism switches to the lock state, the motor is deactivated. Accordingly, the elastic force of a neutral return spring returns the rotary member to a neutral position and the elastic force of the holding spring returns the operation lever to a predetermined position. Then, when the rotary member rotates again in the forward direction, the operation lever moves against the elastic force of the holding spring and moves a switching lever. This moves an engagement pin to a position that activates a swinging mechanism. The rotary member includes a super lock cancellation step. When the rotary member rotates in a reverse direction, the super lock cancellation step engages the switching lever and moves the engagement pin to a position that deactivates the swinging mechanism.

PRIOR ART DOCUMENT

Patent Document

Patent Document 1 . . . Japanese Laid-Open Patent Publication No. 7-71151

SUMMARY OF THE INVENTION

In patent document 1, the sill knob drive lever only moves between an unlock side (unlock position) and a lock side (lock position). In other words, the switching of the vehicle door to the double lock state is performed using the operation lever and a link mechanism, which includes the switching lever, intermediate lever, and bent lever. Accordingly, these dedicated components, which are used to switch the vehicle door to a double lock state, results in the door lock device having a complicated structure.

It is an object of the present invention to provide a door lock device having a simplified structure that is capable of switching a vehicle door between the three states of an unlock state, a lock state, and a double lock state (super lock state) with a single electrical drive source and without the need for electrical control to be executed.

To achieve the above-described object, one aspect of the present invention provides a door lock device including a latch mechanism, a locking lever, a double lock lever, an electrical drive source, a drive member, and a return urging member. The latch mechanism holds a vehicle door in a state closing a vehicle body. The latch mechanism is operated to be in a state allowing for the vehicle door to open the vehicle body when operation force from a passenger compartment or operation force from outside the passenger compartment is transmitted. The locking lever is linked to the vehicle door and is switchable between an unlock position, a lock position, and a double lock position. The locking lever when arranged at the unlock position allows the transmission of the operation force from the passenger compartment or the operation force from outside the passenger compartment to the latch mechanism. The locking lever when arranged at the lock position disables transmission of the operation force from outside the passenger compartment to the latch mechanism and allows the operation force from the passenger compartment to be applied to the locking lever thereby moving the locking lever to the unlock position. The locking lever when arranged at the double lock position disables transmission of the operation force from outside the passenger compartment to the latch mechanism and prevents movement of the locking lever to the unlock position or the lock position even when the operation force from the passenger compartment is applied to the locking lever. The double lock lever is coupled to the locking lever and moved to a first position and a second position respectively corresponding to the unlock position and the lock position of the locking lever. The drive member is linked to the vehicle door and includes a first engagement portion engageable with the locking lever and a second engagement portion engageable with the double lock lever. The drive member is driven by the electrical drive source from a neutral position in a first direction and a second direction that is opposite to the first direction. A return urging member returns the drive member to the neutral position when the electrical drive source stops operating. The drive member is formed to push the locking lever with the first engagement portion and move the locking lever to the lock position while restricting movement of the double lock lever to the second position when the drive member moves from the neutral portion in the first direction in a state in which the locking lever is arranged at the unlock position. The drive member is formed to disengage from the double lock lever when the drive member subsequently returns to the predetermined neutral position to allow the double lock lever to move to the second position and disengage the first engagement portion from the locking lever. The drive member is formed to push the double lock lever, which is located at the second position, with the second engagement portion and move the locking lever to the double lock position when the drive member moves again in the first direction from the neutral position.

Preferably, the door lock device further includes a base member fixed to the vehicle door and a stopper formed on the base member. The drive member is formed to push the locking lever with the first engagement portion and move the locking lever to the lock position at which the double lock lever engages with the stopper while restricting movement of the double lock lever to the second position when the drive member moves from the neutral portion in the first direction in a state in which the locking lever is arranged at the unlock position. The drive member is formed to be disengaged from the double lock lever when the drive member subsequently returns to the neutral position to allow the double lock lever to move to the second position. The double lock lever is formed to disengage from the stopper when moved to the second position thereby allowing the locking lever to move from the lock position to the double lock position.

Preferably, the base member further includes a guide. The stopper includes a first guide portion and a second guide portion. The first guide portion is formed to guide the double lock lever in a state held at the first position when the locking lever moves from the unlock position to the lock position. The second guide portion is formed to guide the double lock lever in a state held at the second position when the locking lever moves from the lock position to the double lock position.

In the structures described above, the switching of the vehicle door to the unlock state, the lock state, and the double state is performed without executing electrical control and by performing driving the drive member in the first direction and second direction with the electrical drive source. More specifically, the states of engagement of the drive member with the locking lever and the double lock lever is changed in accordance with the movements of the locking lever and the double lock lever to switch the states of the vehicle door. Accordingly, the switching of the vehicle door to the unlock state, the lock state, and the double lock state is performed with an extremely simple structure including the locking lever, which moves between the three positions of the unlock position, the lock position, and the double lock position, and the double lock lever, which moves in cooperation with the locking lever. Further, the number of components related with the switching is reduced.

Preferably, the drive member and the locking lever are pivotally supported by the base member so as to be coaxial.

In this structure, the layout space for the drive member and the locking lever is decreased thereby allowing for reduction in the overall size. In particular, the locking lever is moved to the unlock position, the lock position, and the double lock position by pivoting about the same axis. This allows for the overall door lock device to be reduced in size.

Preferably, the door lock device further includes two hooking projections arranged next to each other on the locking lever and a holding member supported on the base member. The holding member is formed to elastically clamp a different number of the hooking projections in correspondence with each of the unlock position, the lock position, and the double lock position of the locking lever.

In this structure, the holding member selectively clamps the two hooking projections, which are arranged next to each other on the locking lever. This stably holds the locking lever at the unlock position, the lock position, and the double lock position. In particular, the holding member elastically clamps a different number of the hooking projections to hold the locking lever at each of the unlock position, the lock position, and the double lock position of the locking lever. Thus, a versatile holding member (e.g., snap pin) that basically clamps the required projections in a selective manner may be used as the holding member.

DETAILED DESCRIPTION OF THE PREFERRED EMBODIMENTS

One embodiment of the present invention will now be discussed with reference to the drawings.

Figure 1:
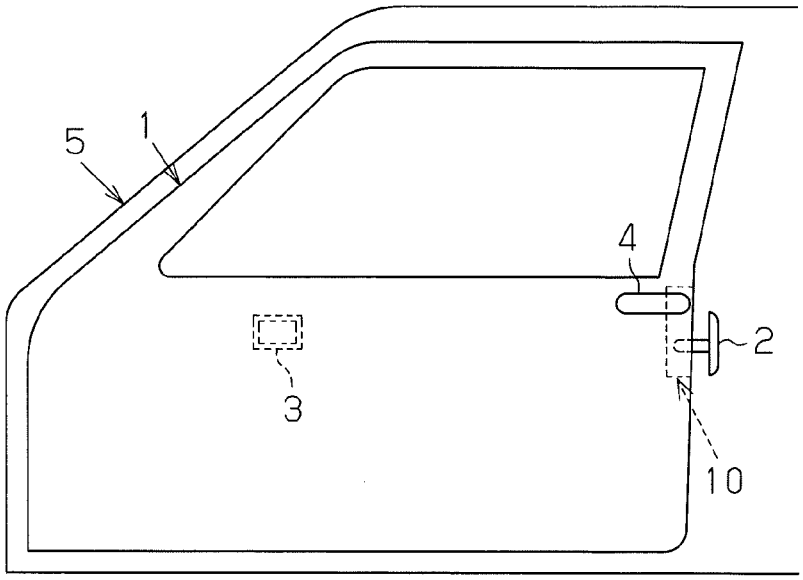
FIG. 1 is a front view showing a vehicle door to which a door lock device according to one embodiment of the present invention is applied.

As shown in FIG. 1, a door lock device 10 is arranged in a vehicle door 1 along a rear edge of the vehicle door 1. The door lock device 10 is engaged with a striker 2, which is fixed to a vehicle body 5, to hold the vehicle door 1 in a state closing the body 5. The vehicle door 1 has an inner wall on which an inside handle 3 is arranged in a state exposed to the passenger compartment. The vehicle door 1 also has an outer wall on which an outside handle 4 is arranged in a state exposed to the outside of the passenger compartment. The door lock device 10 of the present embodiment is of a so-called knobless type, which does not include a lock knob in the passenger compartment for unlocking and locking operations.

Figure 2:
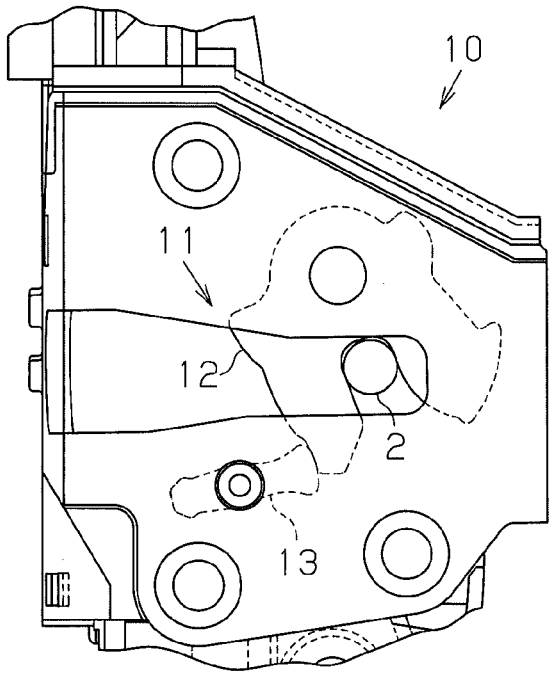
FIG. 2 is an elevated view showing a latch mechanism of a latch mechanism in the door lock device.

As shown in FIG. 2, the door lock device 10 includes a latch mechanism 11, with the latch mechanism 11 including a latch 12 and a pole 13. The latch mechanism 11 engages the striker 2 to hold the vehicle door 1 in a state closing the vehicle body 5. When closing the vehicle door 1, the latch 12 rotates in a first direction and engages the striker 2. Further, the pole 13 engages the latch 12 to hinder rotation of the latch 12 and hold the vehicle door 1 in a closed state. When the pole 13 is rotated to permit rotation of the latch 12, the urging force of a return spring (not shown) rotates the latch 12 in a second direction, which is opposite the first direction. This disengages the latch 12 and the striker 2 thereby allowing the vehicle door 1 to open the vehicle body 5.

Figure 3:
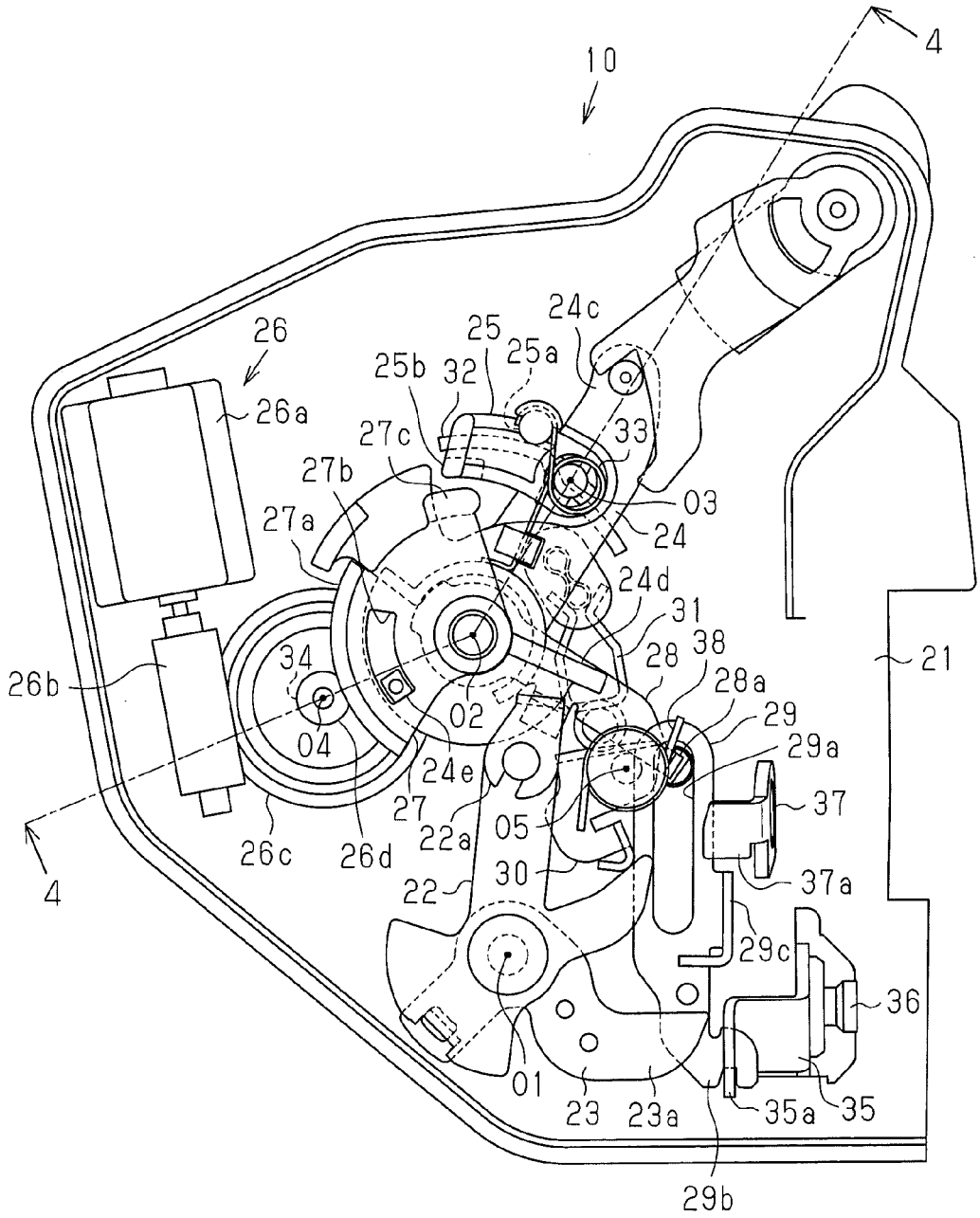
FIG. 3 is a side view showing the door lock device and its movement.
Figure 4:
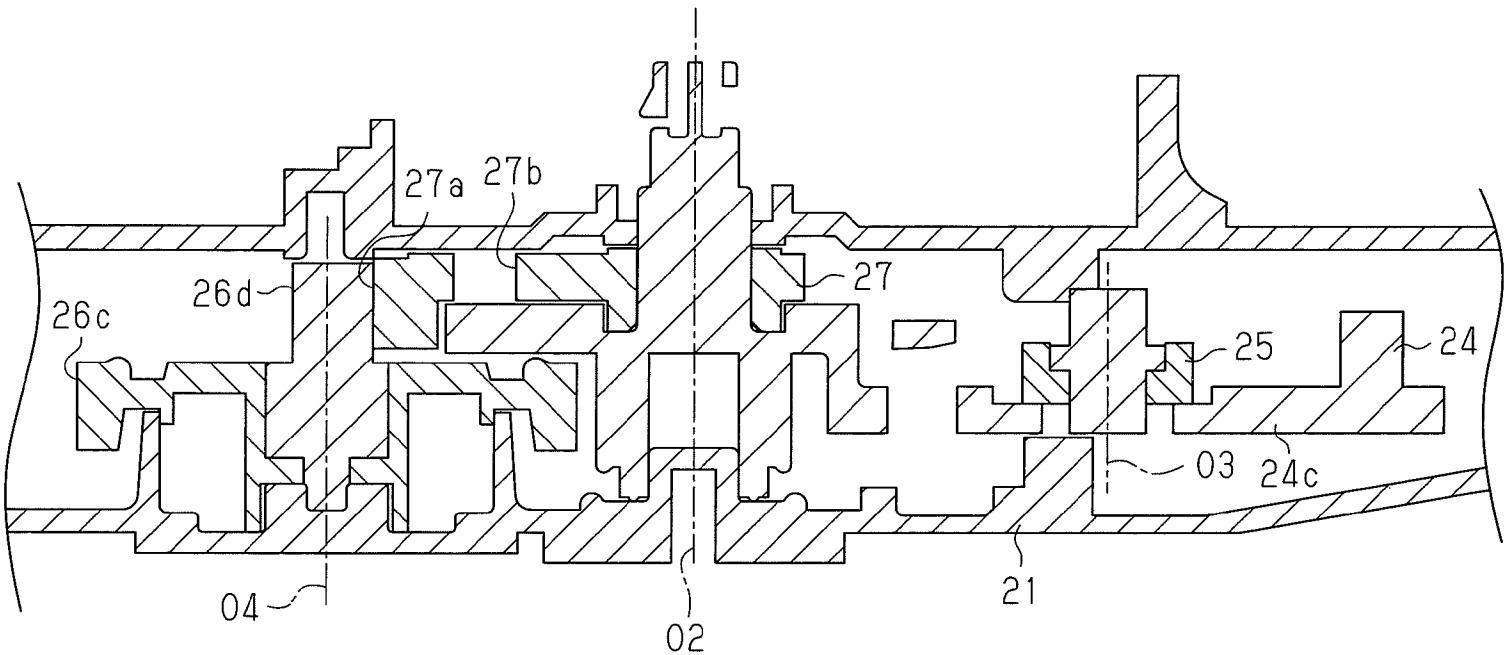
FIG. 4 is a cross-sectional view taken along line 4-4 in FIG. 3.

The door lock device 10 will now be described in detail with reference to FIGS. 3 to 10. FIG. 3 is a side view showing the door lock device 10. FIG. 4 is a cross-sectional view taken along line 4-4 in FIG. 3. FIG. 4 is an enlarged view showing some members of FIG. 3.

As shown in FIG. 3, the door lock device 10 includes a box-shaped housing 21 serving as a base member fixed to the vehicle door 1, an inside lever 22, an inside open lever 23, an active lever 24 serving as a locking lever, a double lock lever 25, a switching actuator 26 serving as an electrical drive source, a sector gear 27 serving as a drive member, a panic lever 28, an open link 29, and a cancel lever 30.

Figure 5:
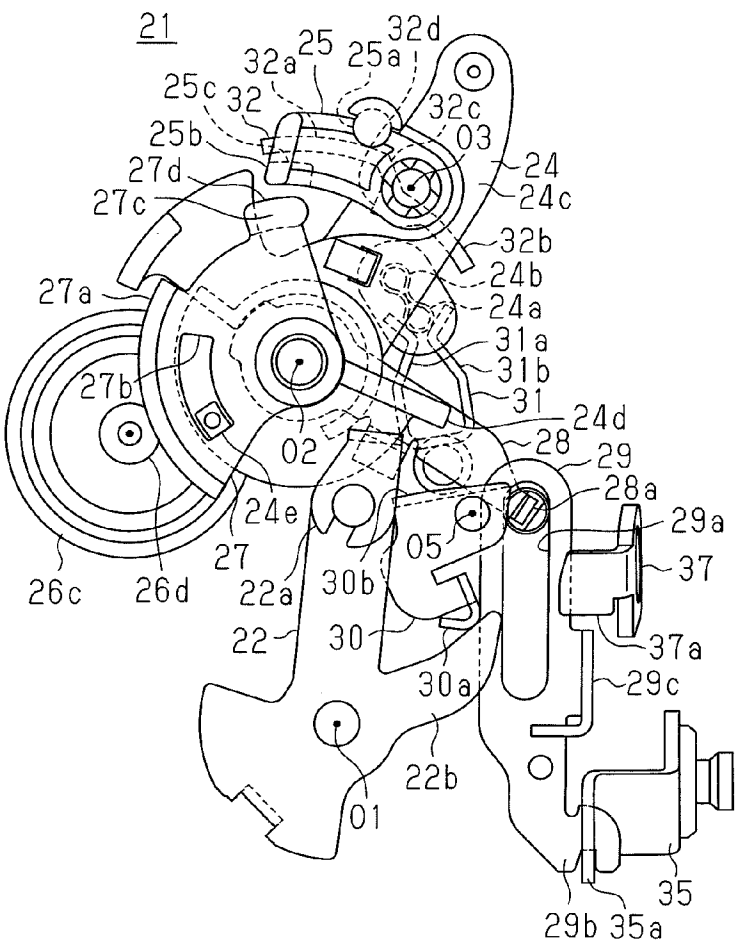
FIG. 5 is a side view showing the door lock device and its movement.

As shown in FIGS. 3 and 5, the inside lever 22, which is formed, for example, by a metal plate, is supported by the housing 21 to be pivotal about a rotation axis O1 in the clockwise direction and counterclockwise direction in a state arranged at a predetermined initial pivot position. The inside lever 22 extends upward as viewed in FIG. 3 and includes a distal portion bent back toward the rotation axis O1 and defining a scissor-shaped hooking piece 22*a*. The hooking piece 22*a* is linked to the inside handle 3 and pivots in the counterclockwise direction as viewed in FIGS. 3 and 5 when an opening operation is performed with the inside handle 3. The inside lever 22 includes a hook-shaped pushing piece 22*b* extending in a first radial direction (upper right side as viewed in FIG. 5) relative to the rotation axis O1.

The inside open lever 23, which is formed, for example, by a metal plate, is arranged at a far side of the inside lever 22 in a direction perpendicular to the plane of the drawing and supported by the housing 21 to be pivotal about the rotation axis O1 in the clockwise direction and counterclockwise direction. The inside open lever 23 is coupled to the inside lever 22 so as to pivot integrally with the inside lever 22. The inside open lever 23 includes a hook-shaped pushing piece 23*a* extending in a second radial direction (lower right side as viewed in FIG. 5) relative to the rotation axis O1. The pushing piece 23*a* is spaced apart from the pushing piece 22*b* of the inside lever 22 in a circumferential direction that extends about the rotation axis O1.

The active lever 24 is formed, for example, from a resin material and arranged at an upper side of the inside lever 22 as viewed in FIG. 5. The active lever 24 is supported by the housing 21 to be pivotal about a rotation axis O2, which is parallel to the rotation axis O1, in the clockwise direction and counterclockwise direction. The housing 21 restricts the pivoting of the active lever 24 within a predetermined range. The active lever 24 includes two hooking projections 24*a* and 24*b*, which are arranged next to each other along a circumferential direction extending about the rotation axis O2. The hooking projections 24*a* and 24*b* have peripheral positions that are arranged adjacently and continuously to define an overall "8"-shaped form. The hooking projections 24*a* and 24*b* are arranged at a far side in a direction perpendicular to the plane of the drawing, that is, toward a bottom wall side of the housing 21. A restraining spring 31, which serves as a holding member that positions the active lever 24, is secured to the housing 21 (bottom wall). The restraining spring 31 includes a coil portion and two L-shaped end portions 31*a* and 31*b*, which extend from the coil portion. The restraining spring 31 is formed by a so-called snap pin and produces an urging force in a direction in which the distance between the end portions 31*a* and 31*b* decreases. The restraining spring 31 elastically clamps the hooking projections 24*a* and 24*b* to maintain the pivotal position of the active lever 24.

Figure 6:
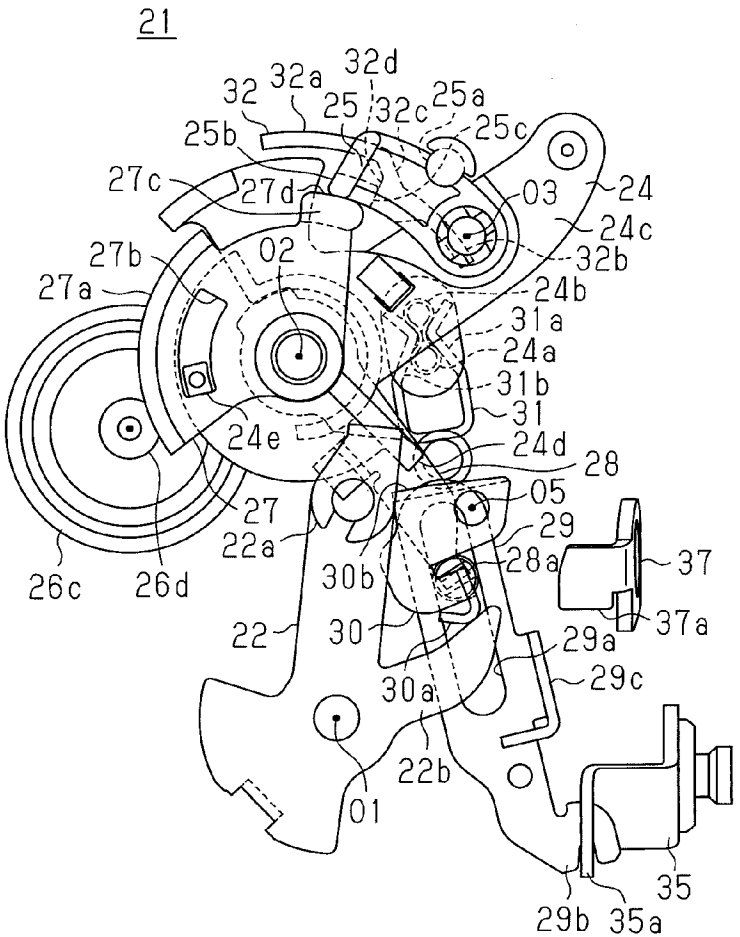
FIG. 6 is a side view showing the door lock device and its movement.
Figure 8:
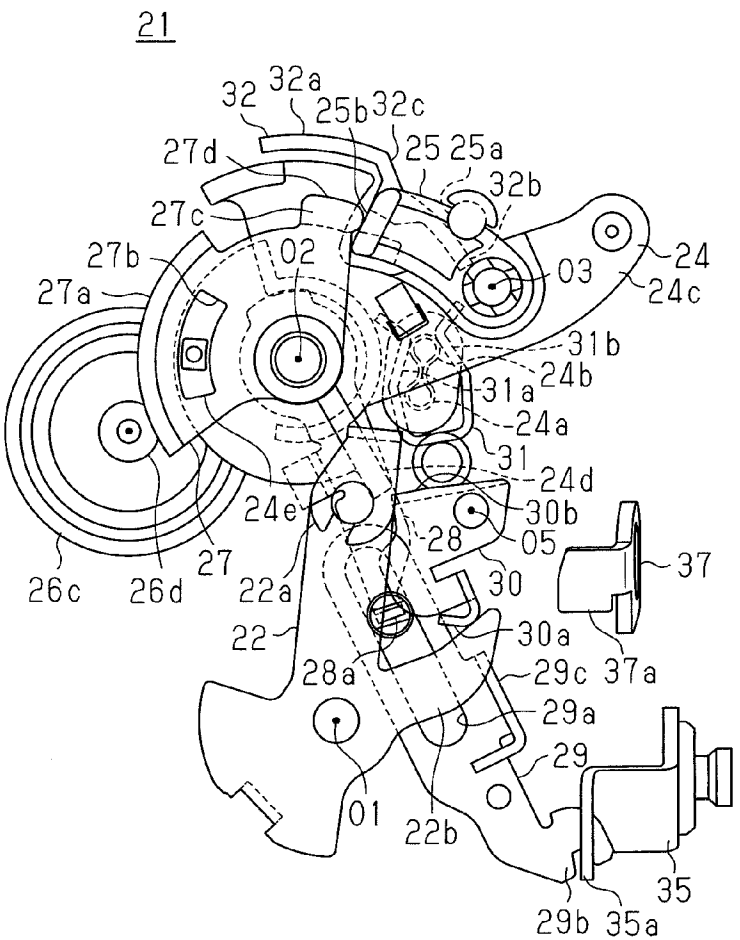
FIG. 8 is a side view showing the door lock device and its movement.
Figure 7:
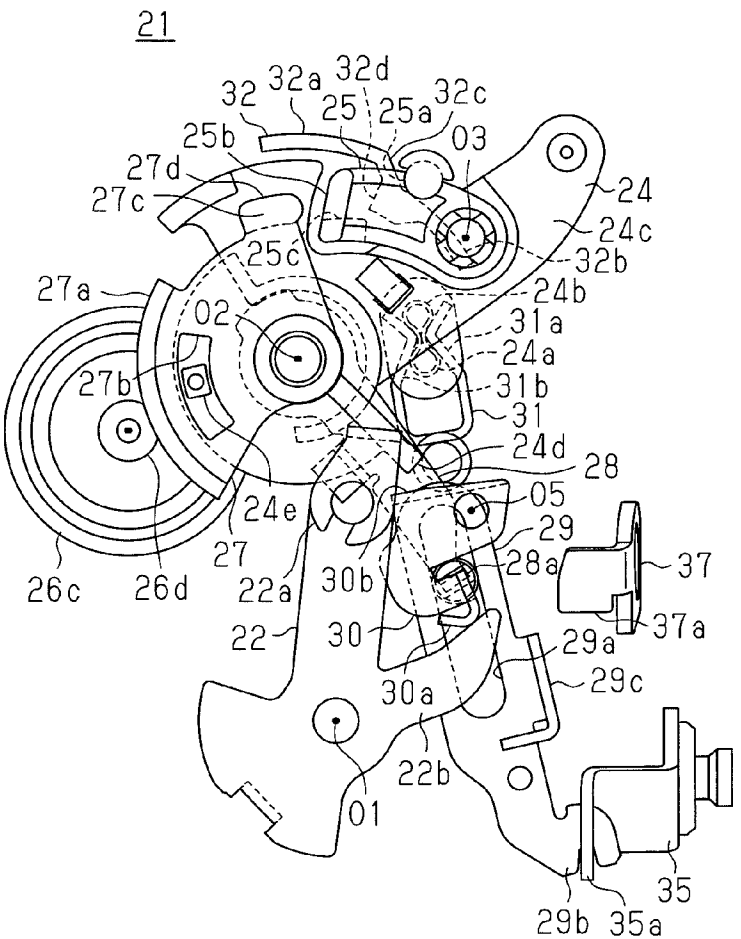
FIG. 7 is a side view showing the door lock device and its movement.
Figure 10:
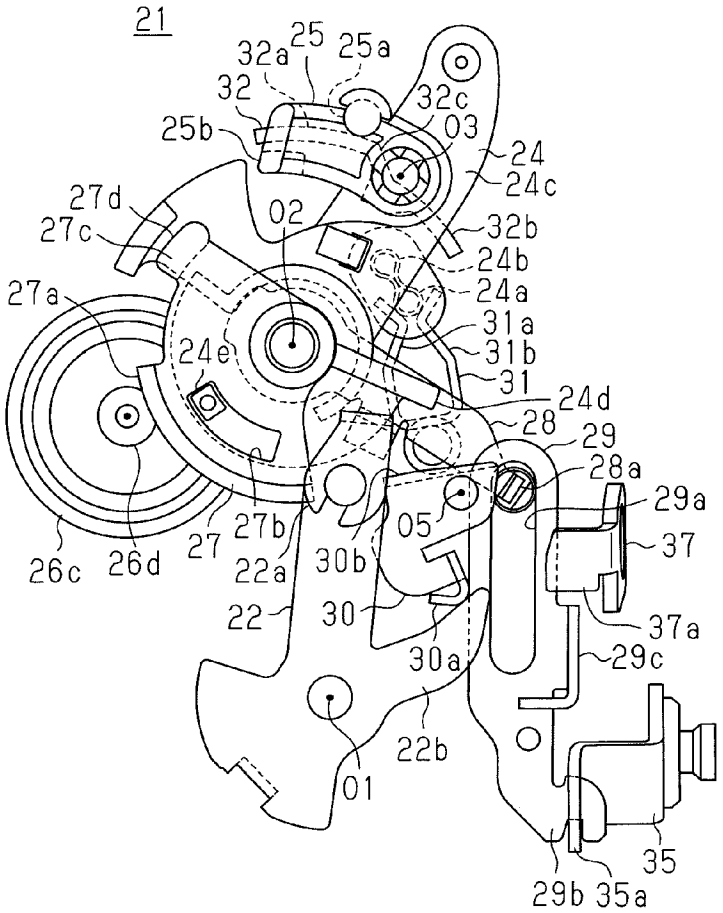
FIG. 10 is a side view showing the door lock device and its movement.
Figure 9:
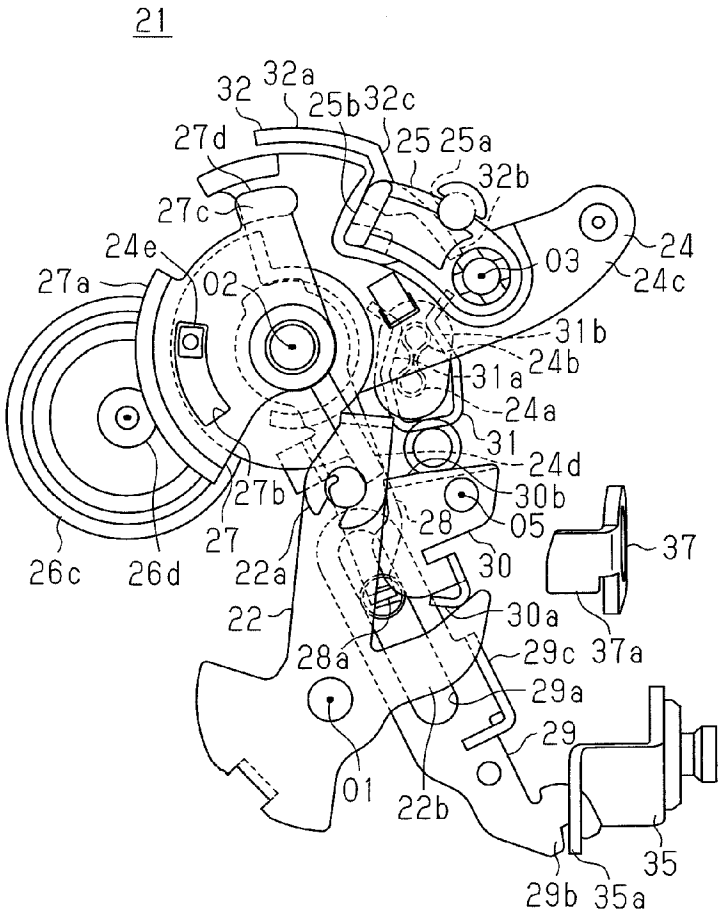
FIG. 9 is a side view showing the door lock device and its movement.

FIGS. 3, 5, and 10 show the active lever 24 in a state arranged at an unlock position. In this state, the housing 21 restricts pivoting of the active lever 24 in the counterclockwise direction, and the restraining spring 31 does not clamp any one of the hooking projections 24*a* and 24*b*. FIGS. 6 and 7 show the active lever 24 in a state arranged at a lock position. In this state, the active lever 24 pivots for only a predetermined angle from the unlock position in the clockwise direction, and the restraining spring 31 clamps just the hooking projection 24*a*. FIGS. 8 and 9 show the active lever 24 in a state arranged at a double lock position. In this state, the active lever 24 pivots for only a predetermined angle from the lock position in the clockwise direction, the housing 21 restricts pivoting of the active lever 24 in the clockwise direction, and the restraining spring 31 clamps every one of the hooking projections 24*a* and 24*b*. In this manner, the restraining spring 31 elastically clamps a different number of the hooking projections 24*a* and 24*b* in correspondence with the unlock position, lock position, and double lock position of the active lever 24.

The active lever 24 includes a coupling piece 24*c*, which extends in a first radial direction (upper side as viewed in FIG. 3) relative to the rotation axis O2, and an abutment piece 24*d*, which extends to the vicinity of the cancel lever 30 in a second radial direction (lower right side as viewed in FIG. 3) relative to the rotation axis O2. The active lever 24 includes a polygonal boss 24*e*, which has the shape of a tetragonal rod and extends toward a near side in a direction perpendicular to the plane of the drawing from a leftward position of the sector gear 27 as viewed in FIG. 5.

The double lock lever 25 is molded, for example, from a resin material and supported by the coupling piece 24*c* of the active lever 24 to be pivotal about a rotation axis O3, which is parallel to the rotation axes O1 and O2, in the clockwise direction and counterclockwise direction. The double lock lever 25 includes a guide pin 25*a* arranged at a far side in a direction perpendicular to the plane of the drawing from the left side of the coupling piece 24*c* as viewed in FIG. 5, that is, toward a bottom wall side of the housing 21. A rib-shaped guide 32, which can abut on the guide pin 25*a*, is formed on the housing 21 (bottom wall) at an inner circumferential side of the guide pin 25*a* relative to the rotation axis O2. As shown in FIG. 5, the guide 32 includes a first guide portion 32*a* and a second guide portion 32*b*, which are arc-shaped and extend in the circumferential direction about the rotation axis O2. The second guide portion has an outer diameter that is shorter than that of the first guide portion 32*a*. The second guide portion 32*b* is arranged adjacent to the first guide portion 32*a* at the clockwise side. An inclined guide portion 32*c* smoothly connects a step extending between the first and second guide portions 32*a* and 32*b* along a radial direction of the rotation axis O2.

The double lock lever 25 includes a distal portion 25*b*. The distal portion 25*b* includes a block-shaped stopper 25*c*, which extends toward the far side in a direction perpendicular to the plane of the drawing, that is, toward the bottom wall of the housing 21. The stopper 25*c* is arranged at an inner circumferential side of the guide 32 (first guide portion 32*a*). The guide 32 includes a step 32*d*, which is located at the inner circumferential side of the inclined guide portion 32*c* relative to the rotation axis O2 and extends in a radial direction relative to the rotation axis O2.

A torsion coil spring 33, which serves as an urging member, is arranged about the rotation axis O3. The torsion coil spring 33 has one end hooked to the active lever 24 and another end hooked to the double lock lever 25 (refer to FIG. 3). This constantly urges the lock lever 25 in a direction in which the guide pin 25*a* abuts on the guide 32 (counterclockwise direction extending about the rotation axis O3 of the guide pin 25*a* in FIG. 3).

When the active lever 24 is located at the unlock position, the guide pin 25*a* abuts on the first guide portion 32*a* (refer to FIG. 5). The pivot position of the double lock lever 25 in this state is referred to as the first position of the double lock lever 25. When the active lever 24 is located at the lock position or the double lock position, the guide pin 25*a* abuts on the second guide portion 32*b* (refer to FIGS. 7 to 9). The pivot positions of the double lock lever 25 in such states are referred to as the second positions of the double lock lever 25.

The double lock lever 25, which is guided by the guide 32, extends in an arc-like manner in the circumferential direction about the rotation axis when located at the first position. Further, the step 32*d* is arranged along a pivot path of the stopper 25*c* extending about the rotation axis O2. Accordingly, when the active lever 24 is pivoted in the clockwise direction to move from the unlock position to the lock position, as the first guide portion 32*a* guides the double lock lever 25, which moves in cooperation with the active lever 24, the stopper 25*c* of the double lock lever 25 abuts on the step 32*d*. This stops the pivoting of the active lever 24 and the double lock lever 25 (refer to FIG. 6). In other words, the abutment of the stopper 25*c* and the step 32*d* stops the active lever 24 at the lock position. Further, the double lock lever 25 is pivoted by an amount corresponding to the step in the radial direction between the first and second guide portions 32*a* and 32*b* relative to the rotation axis O3, that is, in the direction that the distal portion 25*b* moves inward in the radial direction relative to the rotation axis O2. Then, the step 32*d* moves out of the pivot path of the stopper 25*c* about the rotation axis O2.

The switching actuator 26 includes an electric motor 26*a*, a worm 26*b*, and a worm wheel 26*c*. The electric motor 26*a* is arranged in the housing 21 at the left side of the active lever 24 as viewed in FIG. 3. The worm wheel 26*c* is arranged at the far side of the sector gear 27 and the active lever 24 in the direction perpendicular to the plane of the drawing. Further, the worm wheel 26*c* is supported by the housing 21 to be rotatable about a rotation axis O4, which is parallel to the rotation axes O1 to O3. The worm wheel 26*c* has a central portion to which a small-diameter output gear 26*d* is fixed in a state extending toward the near side in the direction perpendicular to the plane of the drawing. The output gear 26*d* rotates integrally with the worm wheel 26*c*. Accordingly, when the electric motor 26*a* is driven to produce rotation, the worm 26*b* and worm wheel 26*c* (worm gear) rotate the output gear 26*d*.

The sector gear 27 is molded, for example, from a resin material, arranged at the near side of the active lever 24 in the direction perpendicular to the plane of the drawing, and supported by the housing 21 to be pivotal about the rotation axis O2 in the clockwise direction and counterclockwise direction. The active lever 24 or the double lock lever 25, which are engaged with the housing 21, restrict the pivoting of the sector gear 27 within a predetermined pivot range. The sector gear 27 includes a fan-shaped gear portion 27*a*, which extends from the rotation axis O2 toward the output gear 26*d* of the switching actuator 26. The axial position of the gear portion 27*a* coincides with the axial position of the output gear 26*d*. The gear portion 27*a* and the output gear 26*d* are mated with each other, and the sector gear 27 is rotated and driven by the switching actuator 26. A return spring 34, which serves as a return urging member, is arranged about the rotation axis O4. The return spring 34 has one end hooked to the housing 21 and another end hooked to the worm wheel 26*c*. The return spring 34 constantly urges the sector gear 27 through the worm wheel 26*c* so as to return the pivot position of the sector gear 27 to a predetermined neutral position when the switching actuator 26 stops operating (stops generating drive force). In other words, the switching actuator 26 rotates and drives the sector gear 27 against the urging force of the return spring 34.

The sector gear 27 also includes an engagement hole 27*b*, which serves as a first engagement portion. The engagement hole 27*b* is arranged at an inner circumferential side of the gear portion 27*a* relative to the rotation axis O2 and extends in the circumferential direction about the rotation axis O2. The polygonal boss 24*e* is inserted into the engagement hole 27*b* from the far side in the direction perpendicular to the plane of the drawing. The engagement hole 27*b* has a first terminal end portion that abuts on or comes into the proximity of the polygonal boss 24*e* when the sector gear 27 is located at the predetermined neutral position and the active lever 24 is located at the unlock position (refer to FIG. 5). Accordingly, in this state, when the sector gear 27 pivots in the clockwise direction, an inner wall surface of the engagement hole 27*b* pushes the polygonal boss 24*e*, and the active lever 24 is pivoted integrally with the sector gear 27 in the clockwise direction. When the stopper 25*c* and the step 32*d* abut against each other, the active lever 24 stops at the lock position (refer to FIG. 6). Further, when the sector gear 27 is located at the predetermined neutral position and the active lever 24 is located at the lock position, the polygonal boss 24*e* is arranged in the engagement hole 27*b* at a central portion in the longitudinal direction (refer to FIG. 7). Further, the pivot path of the stopper 25*c* about the rotation axis O2 is separated from the step 32*d*. Accordingly, in this state, when the sector gear 27 pivots in the clockwise direction or the counterclockwise direction, the polygonal boss 24*e* moves freely in the engagement hole 27*b*. When the sector gear 27 is located at the predetermined neutral position and the active lever 24 is located at the double lock position, a second terminal end portion of the engagement hole 27*b* opposite to the first terminal position abuts on or is in the vicinity of the polygonal boss 24*e* (refer to FIG. 9). Accordingly, in this state, when the sector gear 27 pivots in the counterclockwise direction, the inner wall surface of the engagement hole 27*b* pushes the polygonal boss 24*e*, and the active lever 24 pivots integrally with the sector gear 27 in the counterclockwise direction to move toward the unlock position. Then, the active lever 24 stops at the unlock position when the housing 21 restricts pivoting in the counterclockwise direction (refer to FIG. 10).

The sector gear 27 also includes a hammer-shaped pushing piece 27*c*, which serves as a second engagement portion. The pushing piece 27*c* is located at the inner circumferential side of the guide 32 relative to the rotation axis O2 and is extended to the vicinity of the double lock lever 25. The axial position of the pushing piece 27*c* conforms to the axial position of the double lock lever 25. The double lock lever 25 (distal portion 25*b*) is set to move out of the pivot path of the pushing piece 27*c* when the double lock lever 25 is located at the first position (refer to FIG. 5).

When the sector gear 27 is pivoted in the clockwise direction to move the active lever 24 to the lock position, the guide pin 25*a* of the double lock lever 25 is arranged at the outer circumferential side of the second guide portion 32*b* relative to the rotation axis O2 (refer to FIG. 6). Further, the double lock lever 25, which is urged by the coil spring 33 so as to move toward the second position, abuts on a peripheral surface 27*d* of the pushing piece 27*c*. This restricts the movement of the double lock lever 25. Accordingly, the active lever 24 moves to the lock position without interference with the double lock lever 25 and the sector gear 27.

When the switching actuator 26 stops operating after the active lever 24 moves to the lock position, the return spring 34 urges the sector gear 27 through the worm wheel 26*c*, pivots the sector gear 27 in the counterclockwise direction (recovery pivoting), and returns the sector gear 27 to the predetermined neutral position (refer to FIG. 7). This causes the sector gear 27 to disengage the double lock lever 25 from the peripheral surface 27*d* of the pushing piece 27*c* and allows for the double lock lever 25 to move to the second position. Further, the sector gear 27 arranges the polygonal boss 24*e* in the longitudinally central portion of the engagement hole 27*b* and disengages the polygonal boss 24*e* from the engagement hole 27*b*. The double lock lever 25 (distal portion 25*b*) is set to be arranged in the pivot path of the pushing piece 27*c* when located at the second position.

Accordingly, in this state, when the sector gear 27 pivots again in the clockwise direction, the pushing piece 27*c* pushes the double lock lever 25, which is located at the second position. This pivots the active lever 24, which is coupled to the double lock lever 25, in the clockwise direction about the rotation axis O2 integrally with the sector gear 27 and the double lock lever 25. Further, the active lever 24 stops at the double lock position when the housing 21 restricts pivoting in the clockwise direction abut the rotation axis O2 (refer to FIG. 8). In this state, the polygonal boss 24*e* moves freely relative to the engagement hole 27*b*. Thus, the active lever 24 moves to the double lock position without interference with the polygonal boss 24*e* and the engagement hole 27*b*.

When the switching actuator 26 stops operating after the active lever 24 moves to the double lock position, the return spring 34 urges the sector gear 27 through the worm wheel 26*c*, pivots the sector gear 27 in the counterclockwise direction (recovery pivoting), and returns the sector gear 27 to the predetermined neutral position (refer to FIG. 9). In this state, the second terminal end portion of the engagement hole 27*b* abuts on or is in the vicinity of the polygonal boss 24*e*.

When the sector gear 27 is pivoted in the counterclockwise direction (reverse pivoting) in this state, the inner wall surface of the engagement hole 27*b* pushes the polygonal boss 24*e*, and the active lever 24 pivots integrally with the sector gear 27 in the counterclockwise direction. Then, the housing 21 restricts pivoting in the counterclockwise direction and stops the active lever 24 at the unlock position (refer to FIG. 10). At the same time, the guide pin 25*a*, which is guided from the second guide portion 32*b* via the inclined guide portion 32*c* to the first guide portion 32*a*, moves the double lock lever 25 from the second position to the first position. Then, when the switching actuator 26 stops operating, the return spring 34 urges the sector gear 27 through the worm wheel 26*c*, pivots the sector gear 27 in the counterclockwise direction (recovery pivoting), and returns the sector gear 27 to the predetermined neutral position (refer to FIG. 5).

The switching actuator 26 is driven and controlled for a certain period when a control circuit (not shown) detects a remote operation performed on a switch arranged on a key blade or passenger compartment door trim. In this manner, except for the polarity of the supplied power being changed in accordance with the direction of the rotation produced by the electric motor 26*a*, the switching actuator 26 does not undergo special electrical control (position control). That is, the active lever 24 is mechanically engaged in the manner described above when the switching actuator 26 is being driven to selectively switch between the unlock position, the lock position, and the double lock position.

The panic lever 28 is formed, for example, by a metal plate and is supported by the housing 21 to be pivotal about the rotation axis O2 in the clockwise direction and counterclockwise direction. An urging member (not shown) is arranged on the rotation axis O2. The urging member has one end hooked to the active lever 24 and another end hooked to the panic lever 28. This basically pivots the panic lever 28 integrally with the active lever 24. Further, the panic lever 28 has a distal position to which a hooking pin 28*a* is secured extending in the near side in the direction perpendicular to the plane of the drawing.

The open link 29 is formed, for example, by a metal plate and extends in the vertical direction as viewed in FIG. 5. The open link 29 includes a first end portion with an engagement groove 29*a*, which has the form of an elongated hole and which receives the hooking pin 28*a* of the panic lever 28. The open link 29 is coupled to the panic lever 28 to be movable along the longitudinal direction of the engagement groove 29*a*.

The open link 29 also includes a second end portion, which is opposite to the first end portion, defining a coupling portion 29*b* coupled to an open lever 35, which is arranged on the housing 21. The open link 29 is coupled to be tiltable relative to the open lever 35 and stably arranged at a predetermined pivot position by a torsion spring (not shown). The open lever 35 includes a first end portion 35*a* and a second end portion (not shown), which is arranged opposite to the first end portion 35*a* with a pivot axis of the open lever 35 arranged in between. The first end portion 35*a* is coupled to the coupling portion 29*b* of the open link 29. The second end portion of the open lever 35 is linked to the outside handle 4. When the outside handle 4 is operated in an opening direction, the open lever 35 pivots so that the first end portion 35*a* moves against the torsion spring, that is, moves the open link 29 upward.

Further, the open link 29 includes the coupling portion 29*b*, and an L-shaped engagement piece 29*c* is arranged between the engagement groove 29*a* and the coupling portion 29*b*. The engagement piece 29*c* is arranged in the vicinity of a lift lever 37, which is pivotally coupled to the housing 21. The lift lever 37 is coupled to the pole 13 (refer to FIG. 2) so as to pivot integrally with the pole 13. The lift lever 37 includes a distal portion 37*a*, which is located at the side closer to the engagement piece 29*c*. When the lift lever 37 is pivoted to move the distal portion 37*a* upward and the pole 13 pivots integrally, the latch mechanism 11 and the striker 2 are disengaged from each other thereby allowing the vehicle door 1 to open the vehicle body 5.

The engagement piece 29*c* is arranged along the vertical direction facing toward the pushing piece 23*a* of the inside open lever 23 and in the pivot path of the pushing piece 23*a*. Accordingly, for example, when the inside open lever 23 is pivoted in the counterclockwise direction, the pushing piece 23*a* pushes the end surface of the engagement piece 29*c* facing toward pushing piece 23*a* and moves the open link 29 upward.

The positional relationship of the engagement piece 29*c* and the distal portion 37*a* corresponding to the unlock position, lock position, and double lock position of the active lever 24 will now be discussed. When the active lever 24 is located at the unlock position (refer to FIGS. 3 and 5), the hooking pin 28*a* of the panic lever 28 guides the first end portion of the open link 29 to a first side (right side as viewed in FIGS. 3 and 5). In this state, the engagement piece 29*c* and the distal portion 37*a* are arranged facing toward each other in the vertical direction as viewed in FIGS. 3 and 5, and the engagement groove 29*a* is arranged so that its longitudinal direction conforms to the vertical direction as viewed in FIGS. 3 and 5. Accordingly, by moving the open link 29 (engagement piece 29*c*) upward in this state, the distal portion 37*a* is pushed by the open link 29 (engagement piece 29*c*) and moved upward in the manner described above thereby disengaging the latch mechanism 11 and the striker 2.

When the active lever 24 is located at the lock position (refer to FIG. 7) or the double lock position (refer to FIG. 9), the hooking pin 28*a* of the panic lever 28 guides the first end portion of the open link 29 to a second side (left side as viewed in FIGS. 7 and 9), which is opposite to the first side. In this state, the engagement piece 29*c* is arranged so that an extension line extending from the engagement piece 29*c* along the longitudinal direction of the engagement groove 29*a* is separated from the distal portion 37*a*. Accordingly, even when the open link 29 moves upward, the engagement piece 29*c* does not push and move the distal portion 37*a* upward, and the engagement of the latch mechanism 11 and striker 2 is maintained.

The cancel lever 30 is formed, for example, by a metal plate and arranged between the inside lever 22 and the active lever 24. The cancel lever 30 is supported by the housing 21 to be pivotal about a rotation axis O5, which is parallel to the rotation axes O1 to O4, in the clockwise direction and counterclockwise direction. The cancel lever 30 is formed to be U-shaped and includes a distal portion with a terminal end defining an abutment piece 30*a*. The abutment piece 30*a* is bent to be generally L-shaped in the vicinity of the pushing piece 22*b*. Further, the cancel lever 30 includes an engagement piece 30*b*, which serves as a third engagement portion, has a planar shape, and faces toward the abutment piece 24*d*.

A coil spring 38 is arranged on the rotation axis O5. The coil spring 38 has one end hooked to the housing 21 and another end hooked to the cancel lever 30 (refer to FIG. 3). The coil spring 38 constantly urges the cancel lever 30 toward the side the abutment piece 30*a* abuts on the pushing piece 22*b* of the inside lever 22 (the side in which pivoting occurs in the counterclockwise direction). Accordingly, the cancel lever 30 is held at a predetermined pivot position in correspondence with the inside lever 22 that is arranged at a predetermined initial pivot position. When the inside handle 3 is operated in an opening direction thereby pivoting the inside lever 22 in the counterclockwise direction, the cancel lever 30 is pivoted in the clockwise direction as the abutment piece 30*a* is pushed by the pushing piece 22*b*.

When the active lever 24 is located at the lock position (refer to FIG. 7), the abutment piece 24*d* is arranged in the pivot path of the engagement piece 30*b*. Accordingly, when the inside handle 3 is operated in the opening direction to pivot the cancel lever 30 in the clockwise direction in the manner described above, the engagement piece 30*b* pushes the abutment piece 24*d*. This pivots the active lever 24 in the counterclockwise direction and moves the active lever 24 to the unlock position. Further, after the active lever 24 moves to the unlock position, that is, after the engagement piece 29*c* and the distal portion 37*a* are arranged facing toward each other in the vertical direction, the pushing piece 23*a* of the inside open lever 23, which then pivots integrally with the inside lever 22, pushes the end surface of the engagement piece 29*c* that faces toward the pushing piece 23*a*. This disengages the latch mechanism 11 from the striker 2 in the manner described above. In this manner, the present embodiment employs a so-called one-motion mechanism that completes the shifting of the vehicle door 1 from the lock state to the unlock state with a single operation of the inside handle 3, while disengaging the latch mechanism 11 from the striker 2.

When the active lever 24 is located at the double lock position (refer to FIG. 9), the abutment piece 24*d* is separated from the pivot path of the engagement piece 30*b*. Accordingly, even when the inside handle 3 is operated in the opening direction to pivot the cancel lever 30 in the clockwise direction in the manner described above, the engagement piece 30*b* does not push the abutment piece 24*d*. Further, the engagement piece 30*b* is disengaged from the abutment piece 24*d* (the engagement piece 30*b* moves freely). Accordingly, the active lever 24 remains stopped at the double lock position. In this case, the latch mechanism 11 and the striker 2 remain engaged with each other.

The operation of the present embodiment will now be discussed.

As shown in FIG. 5, in a state in which the active lever 24 is located at the unlock position (unlock state), when the switching actuator 26 is driven to pivot the sector gear 27 in the clockwise direction from the predetermined neutral position, the inner wall surface of the engagement hole 27*b* pushes the polygonal boss 24*e*. This moves the active lever 24 to the lock position (refer to FIG. 6). At the same time, the active lever 24 is held at the lock position with the hooking projection 24*a* being elastically clamped by the restraining spring 31. In this state, movement of the double lock lever 25 to the second position is restricted due to the abutment with the peripheral surface 27*d* of the pushing piece 27*c*.

After the pivoting restriction, which is caused by the abutment of the stopper 25*c* and the step 32*d*, moves the active lever 24 to the lock position, the operation of the switching actuator 26 is automatically stopped when a certain period elapses. The return spring 34 urges the sector gear 27 through the worm wheel 26*c*, pivots the sector gear 27 in the counterclockwise direction (recovery pivoting), and returns the sector gear 27 to the predetermined neutral position (refer to FIG. 7). This disengages the double lock lever 25 from the peripheral surface 27*d* of the pushing piece 27*c* and moves the double lock lever 25 to the second position. Then, the step 32*d* is separated from the pivot path of the stopper 25*c* extending about the rotation axis O2. Further, the polygonal boss 24*e* of the active lever 24 is arranged at the longitudinally central portion of the engagement hole 27*b* and disengaged from the engagement hole 27*b*.

In a state in which the active lever 24 is located at the lock position (lock state), when the switching actuator 26 is driven to pivot the sector gear 27 again in the clockwise direction from the predetermined neutral position, the pushing piece 27*c* pushes the double lock lever 25 (distal portion 25*b*), which is located at the second position. This moves the active lever 24, which is coupled to the double lock lever 25, to the double lock position (refer to FIG. 8). At the same time, the active lever 24 is held at the double lock position with the two hooking projections 24*a* and 24*b* being elastically clamped by the restraining spring 31. In this state, the polygonal boss 24*e* of the active lever 24 moves freely relative to the engagement hole 27*b*.

After the pivoting restriction, which is caused by the housing 21, moves the active lever 24 to the double lock position, the operation of the switching actuator 26 is automatically stopped when a certain period elapses. Then, the return spring 34 urges the sector gear 27 through the worm wheel 26*c*, pivots the sector gear 27 in the counterclockwise direction (recovery pivoting), and returns the sector gear 27 to the predetermined neutral position (refer to FIG. 9). In this state, the second terminal end portion of the engagement hole 27*b* abuts on or is in the vicinity of the polygonal boss 24*e*.

In a state in which the active lever 24 is located at the double lock position (double lock state), when the switching actuator 26 is driven to pivot the sector gear 27 in the counterclockwise direction (reverse pivoting) from the predetermined neutral position, the inner wall surface of the engagement hole 27*b* pushes the polygonal boss 24*e*. This moves the active lever 24 to the unlock position (refer to FIG. 10). At the same time, the active lever 24 is held at the unlock position without any of the hooking projections 24*a* and 24*b* being elastically clamped by the restraining spring 31. In this state, the double lock lever 25 is guided by the guide 32 and moved to the first position.

After the pivoting restriction, which is caused by the housing 21, moves the active lever 24 to the unlock position, the operation of the switching actuator 26 is automatically stopped when a certain period elapses. The return spring 34 urges the sector gear 27 through the worm wheel 26*c*, pivots the sector gear 27 in the counterclockwise direction (recovery pivoting), and returns the sector gear 27 to the predetermined neutral position (refer to FIG. 5).

In this manner, in the present embodiment, the switching actuator 26 pivots the sector gear 27 while the urging force of the return spring 34 returns the sector gear 27 to the predetermined position without the need for special electrical control (position control). This selectively switches the vehicle door 1 between the unlock state, lock state, and double lock state.

When the active lever 24 is located at the lock position (refer to FIG. 7), a single operation of the inside handle 3 completes the shifting of the vehicle door 1 to the unlock state in the manner described above, while disengaging the latch mechanism 11 from the striker 2. When the active lever 24 is located at the double lock position (refer to FIG. 9), the cancel lever 30 swings in the above-described manner even if the inside handle 3 is operated. Thus, the vehicle door 1 does not shift to the unlock state or the like.

As described above in detail, the present embodiment has the advantages described below.

(1) In the present embodiment, the single switching actuator 26 (electric motor 26*a*) drives the sector gear 27 in a first direction and a second direction to switch the vehicle door 1 to the unlock state, lock state, and double lock state. Further, the switching is performed without executing electrical control. In detail, the states of the vehicle door 1 are switched by changing the engagement states of the sector gear 27 with the active lever 24 and the double lock lever 25. Accordingly, the switching to the unlock state, lock state, and double lock state is performed with an extremely simple structure including the active lever 24, which moves to the unlock position, the lock position, and the double lock position, and the double lock lever 25, which moves in cooperation with the active lever 24. Further, the number of components used for the switching may be reduced.

(2) In the present embodiment, the sector gear 27 and the active lever 24, which are pivotally coupled to the housing 21, are coaxial (rotation axis O2). This decreases the layout space for the sector gear 27 and active lever 24 and allows for miniaturization. In particular, the active lever 24 pivots about the same axis (rotation axis O2) to move to the unlock position, the lock position, and the double lock position (i.e., switch the vehicle door 1 to the unlock state, the lock state, and the double lock state). This allows for the overall door lock device to be reduced in size.

(3) In the present embodiment, the restraining spring 31 selectively clamps the two hooking projections 24*a* and 24*b*, which are arranged next to each other on the active lever 24, to stably hold the active lever 24 at the unlock position, the lock position, and the double lock position. In particular, the restraining spring 31 holds the active lever 24 at the unlock position, the lock position, and the double lock position by elastically clamping a different number of the hooking projections 24*a* and 24*b* for each position. Thus, a versatile snap pin that basically clamps the required projections in a selective manner may be used as the restraining spring 31.

(4) In the present embodiment, without executing electrical control, the single switching actuator 26 switches the vehicle door 1 to the unlock state, the lock state, and the double lock state. Thus, for example, a sensor or the like for detecting the pivot position of the active lever is unnecessary, and the electrical structure may be simplified thereby reducing costs. Further, when arranging the active lever 24 at the unlock position, the lock position, or the double lock position, the movement of the active lever 24 caused by the drive force of the switching actuator 26 is mechanically stopped. Thus, in comparison to when detecting the position of the active lever with, for example, a sensor or the like, the position of the active lever 24 is prevented from varying. This improves the reliability of the overall device.

(5) In the present embodiment, when in the lock state, the inside handle 3 is operated (operation force from the passenger compartment is received) to move the inside lever 22. As a result, the abutment piece 24*d* of the active lever 24 pushes the engagement piece 30*b* of the cancel lever 30, which moves integrally with the inside lever 22, and the active lever 24 may be moved to the unlock position. In particular, when the door lock device is of a knobless type structure, the movement of the inside lever 22 caused by the receipt of the operation force from the passenger compartment moves the active lever 24 to the unlock position.

The embodiment discussed above may be modified as described below.

The first guide portion 32*a* and the second guide portion 32*b* do not necessarily have to be arc-shaped and may be linear.

The first guide portion 32*a* does not necessarily have to be included in the guide 32, and the sector gear 27 may have the function of the first guide portion 32*a*. In detail, when moving the active lever 24 from the unlock position to the lock position, as long as the sector gear 27 abuts on the double lock lever 25 and holds the double lock lever 25 at the first position, the first guide portion 32*a* is not necessary.

In the above-described embodiment, the housing 21 restricts the pivoting of the active lever 24 to stop the active lever 24 at the unlock position or the lock position. However, the embodiment described above is not limited to the foregoing description. For example, pivoting of the sector gear 27 may be restricted with the housing 21 so that the active lever 24, which moves in cooperation with the sector gear 27, stops at the unlock position or the lock position.

In the above-described embodiment, the return urging member (return spring 34) urges the worm wheel 26*c* and returns the sector gear 27 to the predetermined neutral position. However, the embodiment described above is not limited to the foregoing description and the return urging member may urge a member other than the worm wheel 26*c* at the upstream side of the rotary shaft of the electric motor 26*a* with respect to power transmission. For example, the return urging member may directly urge the sector gear 27 to return the sector gear 27 to the predetermined neutral position. The structure for power transmission between the rotary shaft of the electric motor 26*a* and the sector gear 27 is just one example. For instance, the worm 26*b* of the electric motor 26*a* may be directly mated with the gear portion 27*a* of the sector gear 27.

In the above-described embodiment, the peripheral portions of the adjacent hooking projections 24*a* and 24*b* are connected to be integral. However, the hooking projections 24*a* and 24*b* may be separated from each other.

The inside lever 22 and the inside open lever 23 may be formed integrally.

The base member (housing 21) to which the active lever 24 and the like are coupled may be a suitable bracket fixed to the vehicle door 1 or a frame that forms the framework of the vehicle door 1.

When the vehicle door 1 is in the lock state, the shifting to the unlock state may be completed by a single operation of the inside handle 3. Accordingly, the disengagement of the latch mechanism 11 and the striker 2 may be performed by a second operation of the inside handle 3 (so-called two-motion mechanism).

The present invention may be applied to a door lock device including a lock knob. In this case, only lock operations from the passenger compartment with the lock knob are permitted, and unlocking operations are prohibited by using a suitable swinging mechanism. When applying such a lock knob, the "operation force from a passenger compartment" recited in claim 1 may be the operation force of the inside handle 3 or the operation force of the lock knob. Alternatively, after the lock operation of the lock knob from the passenger compartment, the lock knob may be drawn into the vehicle door 1 so as to disable direct operation. When using such a drawn-in type lock knob, the "operation force from a passenger compartment" recited in claim 1 may be the operation force of the inside handle 3.

DESCRIPTION OF THE REFERENCE CHARACTERS

1 . . . vehicle door, 10 . . . door lock device, 11 . . . latch mechanism, 21 . . . housing (base member), 22 . . . inside lever, 24 . . . active lever (locking lever), 24*a* and 24*b* . . . hooking projections, 25 . . . double lock lever, 26 . . . switching actuator (electrical drive source), 27 . . . sector gear (drive member), 27*b* . . . engagement hole (first engagement portion), 27*c* . . . pushing piece (second engagement portion), 30 . . . cancel lever, 31 . . . restraining spring (holding member), 32 . . . guide, 32*a* . . . first guide portion, 32*b* . . . second guide portion, 32*d* . . . step (stopper), 34 . . . return spring (return urging member).

The invention claimed is:

1. A door lock device comprising:

a latch mechanism that holds a vehicle door in a state closing a vehicle body, the latch mechanism being operated to be in a state allowing for the vehicle door to open the vehicle body when operation force from a passenger compartment or operation force from outside the passenger compartment is transmitted;

a locking lever linked to the vehicle door and being switchable between an unlock position, a lock position, and a double lock position, the locking lever when arranged at the unlock position allowing the transmission of the operation force from the passenger compartment or the operation force from outside the passenger compartment to the latch mechanism, the locking lever when arranged at the lock position disabling transmission of the operation force from outside the passenger compartment to the latch mechanism and allowing the operation force from the passenger compartment to be applied to the locking lever thereby moving the locking lever to the unlock position, and the locking lever when arranged at the double lock position disabling transmission of the operation force from outside the passenger compartment to the latch mechanism and preventing movement of the locking lever to the unlock position or the lock position even when the operation force from the passenger compartment is applied to the locking lever;

a double lock lever coupled to the locking lever and moved to a first position and a second position respectively corresponding to the unlock position and the lock position of the locking lever;

an electrical drive source;

a drive member linked to the vehicle door and including a first engagement portion engageable with the locking lever and a second engagement portion engageable with the double lock lever, the drive member being driven by the electrical drive source from a neutral position in a first direction and a second direction that is opposite to the first direction; and a return urging member that returns the drive member to the neutral position when the electrical drive source stops operating;

wherein the drive member is formed to push the locking lever with the first engagement portion and move the locking lever to the lock position while restricting movement of the double lock lever to the second position when the drive member moves from the neutral position in the first direction in a state in which the locking lever is arranged at the unlock position, and the drive member is formed to disengage from the double lock lever when the drive member subsequently returns to the predetermined neutral position to allow the double lock lever to move to the second position and disengage the first engagement portion from the locking lever; and the drive member is formed to push the double lock lever, which is located at the second position, with the second engagement portion and move the locking lever to the double lock position when the drive member moves again in the first direction from the neutral position.

2. The door lock device according to claim 1, further comprising:

a base member fixed to the vehicle door; and a stopper formed on the base member;

wherein the drive member is formed to push the locking lever with the first engagement portion and move the locking lever to the lock position at which the double lock lever engages with the stopper while restricting movement of the double lock lever to the second position when the drive member moves from the neutral portion in the first direction in a state in which the locking lever is arranged at the unlock position, and the drive member is formed to be disengaged from the double lock lever when the drive member subsequently returns to the neutral position to allow the double lock lever to move to the second position; and the double lock lever is formed to disengage from the stopper when moved to the second position thereby allowing the locking lever to move from the lock position to the double lock position.

3. The door lock device according to claim 2, wherein the base member further includes a guide, and the guide comprises:

the stopper;

a first guide portion formed to guide the double lock lever in a state held at the first position when the locking lever moves from the unlock position to the lock position; and a second guide portion formed to guide the double lock lever in a state held at the second position when the locking lever moves from the lock position to the double lock position.

4. The door lock device according to claim 2, wherein the drive member and the locking lever are pivotally supported by the base member so as to be coaxial.

5. The door lock device according to claim 2, further comprising:

two hooking projections arranged next to each other on the locking lever; and a holding member supported on the base member;

wherein the holding member is formed to elastically clamp a different number of the hooking projections in correspondence with each of the unlock position, the lock position, and the double lock position of the locking lever.

6. The door lock device according to claim 3, wherein the first guide portion and the second guide portion are arc-shaped.

7. The door lock device according to claim 5, wherein the two hooking projections are integrated with each other by connecting their adjacent peripheral portions.

8. The door lock device according to claim 2, further comprising:

an inside lever linked to the vehicle door and receiving the operation force from the passenger compartment; and a cancel lever linked to the inside lever and including a third engagement portion engageable with the locking lever;

wherein the locking lever is pushed by the third engagement portion of the cancel lever to move to the unlock position when the inside lever receives the operation force from the passenger compartment in a state arranged at the lock position; and the locking lever is disengaged from the third engagement portion of the cancel lever so that the locking lever does not move when located at the double lock position.

9. The door lock device according to claim 8, wherein the inside lever is supported by the base member to be pivotal about a rotation axis when arranged at an initial pivot position.

10. The door lock device according to claim 3, wherein the drive member and the locking lever are pivotally supported by the base member so as to be coaxial.

11. The door lock device according to claim 10, further comprising:

two hooking projections arranged next to each other on the locking lever; and a holding member supported on the base member;

wherein the holding member is formed to elastically clamp a different number of the hooking projections in correspondence with each of the unlock position, the lock position, and the double lock position of the locking lever.

12. The door lock device according to claim 11, wherein the two hooking projections are integrated with each other by connecting their adjacent peripheral portions.

13. The door lock device according to claim 11, further comprising:

an inside lever linked to the vehicle door and receiving the operation force from the passenger compartment; and a cancel lever linked to the inside lever and including a third engagement portion engageable with the locking lever;

wherein the locking lever is pushed by the third engagement portion of the cancel lever to move to the unlock position when the inside lever receives the operation force from the passenger compartment in a state arranged at the lock position; and the locking lever is disengaged from the third engagement portion of the cancel lever so that the locking lever does not move when located at the double lock position.

14. The door lock device according to claim 13, wherein the inside lever is supported by the base member to be pivotal about a rotation axis when arranged at an initial pivot position.

15. The door lock device according to claim 3, further comprising:

two hooking projections arranged next to each other on the locking lever; and a holding member supported on the base member;

wherein the holding member is formed to elastically clamp a different number of the hooking projections in correspondence with each of the unlock position, the lock position, and the double lock position of the locking lever.

16. The door lock device according to claim 15, wherein the two hooking projections are integrated with each other by connecting their adjacent peripheral portions.

17. The door lock device according to claim 5, further comprising:

an inside lever linked to the vehicle door and receiving the operation force from the passenger compartment; and a cancel lever linked to the inside lever and including a third engagement portion engageable with the locking lever;

wherein the locking lever is pushed by the third engagement portion of the cancel lever to move to the unlock position when the inside lever receives the operation force from the passenger compartment in a state arranged at the lock position; and the locking lever is disengaged from the third engagement portion of the cancel lever so that the locking lever does not move when located at the double lock position.

18. The door lock device according to claim 4, further comprising:

two hooking projections arranged next to each other on the locking lever; and a holding member supported on the base member;

wherein the holding member is formed to elastically clamp a different number of the hooking projections in correspondence with each of the unlock position, the lock position, and the double lock position of the locking lever.

19. The door lock device according to claim 3, further comprising:

an inside lever linked to the vehicle door and receiving the operation force from the passenger compartment; and a cancel lever linked to the inside lever and including a third engagement portion engageable with the locking lever;

wherein the locking lever is pushed by the third engagement portion of the cancel lever to move to the unlock position when the inside lever receives the operation force from the passenger compartment in a state arranged at the lock position; and the locking lever is disengaged from the third engagement portion of the cancel lever so that the locking lever does not move when located at the double lock position.

20. The door lock device according to claim 19, wherein the inside lever is supported by the base member to be pivotal about a rotation axis when arranged at an initial pivot position.

* * * * *